US009814991B2

(12) United States Patent
Van Winkle et al.

(10) Patent No.: US 9,814,991 B2
(45) Date of Patent: Nov. 14, 2017

(54) ACTUATABLE MOTION BASE SYSTEM

(71) Applicant: Universal City Studios LLC, Universal City, CA (US)

(72) Inventors: Ted W. Van Winkle, Celebration, FL (US); Paula Stenzler, Orlando, FL (US); Steven C. Blum, Orlando, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 0 days.

(21) Appl. No.: 14/873,945

(22) Filed: Oct. 2, 2015

(65) Prior Publication Data

US 2016/0096114 A1 Apr. 7, 2016

Related U.S. Application Data

(60) Provisional application No. 62/060,799, filed on Oct. 7, 2014.

(51) Int. Cl.

| | |
|---|---|
| ***A63G 31/16*** | (2006.01) |
| ***A63G 1/00*** | (2006.01) |
| ***A63G 7/00*** | (2006.01) |

(52) U.S. Cl.

CPC ..... *A63G 31/16* (2013.01); *A63G 1/00* (2013.01); *A63G 7/00* (2013.01)

(58) Field of Classification Search

CPC ..... A63G 31/16

See application file for complete search history.

(56) References Cited

U.S. PATENT DOCUMENTS

| | | | | |
|---|---|---|---|---|
| 884,594 | A | 4/1908 | LaComme | |
| 5,893,802 | A * | 4/1999 | Bohme | A63G 31/00 472/131 |
| 6,027,342 | A | 2/2000 | Brown | |
| 7,094,157 | B2 * | 8/2006 | Fromyer | A63G 31/12 434/55 |
| 8,287,394 | B2 * | 10/2012 | Gil | A47C 1/12 434/55 |
| 8,403,673 | B2 | 3/2013 | Atluri et al. | |
| 2005/0048446 | A1 | 3/2005 | Fromyer et al. | |
| 2013/0087005 | A1 | 4/2013 | Van Lookeren Campagne et al. | |
| 2013/0292981 | A1 | 11/2013 | Liao | |
| 2014/0057245 | A1 * | 2/2014 | Martinez | G01M 7/027 434/375 |

FOREIGN PATENT DOCUMENTS

KR 200450514 Y1 10/2010

* cited by examiner

*Primary Examiner* — Michael Dennis

(74) *Attorney, Agent, or Firm* — Fletcher Yoder, P.C.

(57) ABSTRACT

A method in accordance with present embodiments includes receiving a signal that a vehicle is positioned on a motion base system; and actuating a plurality of motion bases of the motion base system to actuate independently of one another to cause the vehicle to roll, pitch, or heave. Actuating the plurality of motion bases includes providing a first signal to an electrical actuator associated with a first motion base; actuating a movable deck of the first motion base to move a first distance relative to its housing at a first time point; providing a second signal to an electrical actuator associated with a second motion base; and actuating a movable deck of the second motion base to move a second distance relative to its housing at the first time point.

23 Claims, 7 Drawing Sheets

ACTUATABLE MOTION BASE SYSTEM

CROSS-REFERENCE TO RELATED APPLICATIONS

The present application claims the benefit of U.S. Provisional Application No. 62/060,799, entitled "Actuatable Motion Base System" and filed Oct. 7, 2014, the disclosure of which is incorporated herein by reference for all purposes

FIELD OF DISCLOSURE

The present disclosure relates generally to the field of amusement parks. More specifically, embodiments of the present disclosure relate to actuatable motion bases.

BACKGROUND

Theme or amusement park ride attractions have become increasingly popular. Certain types of rides provide immersive experiences that include images, sounds, and/or physical effects (e.g., smoke effects) that are used in conjunction with the movement of the ride. For example, the motion of a passenger vehicle can be synchronized with projected images to emphasize a feeling of speed or falling. Depending on the type of passenger vehicle or ride, different types of motion may augment the ride experience. Track-based vehicles are capable of forward or translational motion along the axis of the track. In addition, such vehicles may be capable of other types of motion. For certain rides, passenger vehicles are moved via a motion base that can move the passenger platform or ride vehicle in several different directions including angular movements, such as roll, pitch and yaw, and linear movements, such as heave and surge. These various degrees of freedom can be used to simulate the effect of actually moving in synchronization with the projected images or motion picture. For example, in an amusement ride that attempts to simulate the feeling of racing through city streets in an automobile, the motion base might use a combination of roll and yaw to give passengers the feeling of moving around sharp turns while the image on the screen shows a view of rounding a curve in the street. However, to move heavy passenger vehicles, such motion bases are correspondingly large and heavy and, therefore, energy inefficient.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, an amusement park ride system, includes one or more motion bases. Each motion base includes a housing; a deck configured to move relative to the housing along a guide path when actuated; an actuator coupled to the deck and configured to cause the deck to be actuated; a counterbalance coupled to the deck and configured to change an internal pressure or move when the deck is actuated; and one or more motion guides coupled to the deck and configured to move in conjunction with the deck relative to the housing when the deck is actuated to define the movement of the deck along the guide path; and a controller coupled to the one or more motion bases and configured to independently control the actuator of each motion base.

In accordance with another embodiment, a method includes receiving a signal that a vehicle is positioned on a motion base system; and actuating a plurality of motion bases of the motion base system to actuate independently of one another to cause the vehicle to roll, pitch, heave, yaw, sway, or surge. Actuating the plurality of motion bases includes providing a first signal to an electrical actuator associated with a first motion base; actuating a movable deck of the first motion base to move a first distance relative to its housing at a first time point; providing a second signal to an electrical actuator associated with a second motion base; and actuating a movable deck of the second motion base to move a second distance relative to its housing at the first time point.

In accordance with another embodiment, a motion base system includes a motion base. The motion base includes a housing; a deck configured to move relative to the housing when actuated; an actuator coupled to the deck and configured to cause the deck to be actuated; a counterbalance coupled to the deck and configured to bear a weight of the deck and an additional load comprising a portion of more of a static weight and/or a dynamic inertia of a load resting on or coupled to the deck; one or more motion guides coupled to the deck and configured to move in conjunction with the deck relative to the housing when the deck is actuated to define the movement of the deck; and a controller coupled to the motion base and configured to control the actuator to actuate the deck to move between a plurality of positions as part of an actuation pattern.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
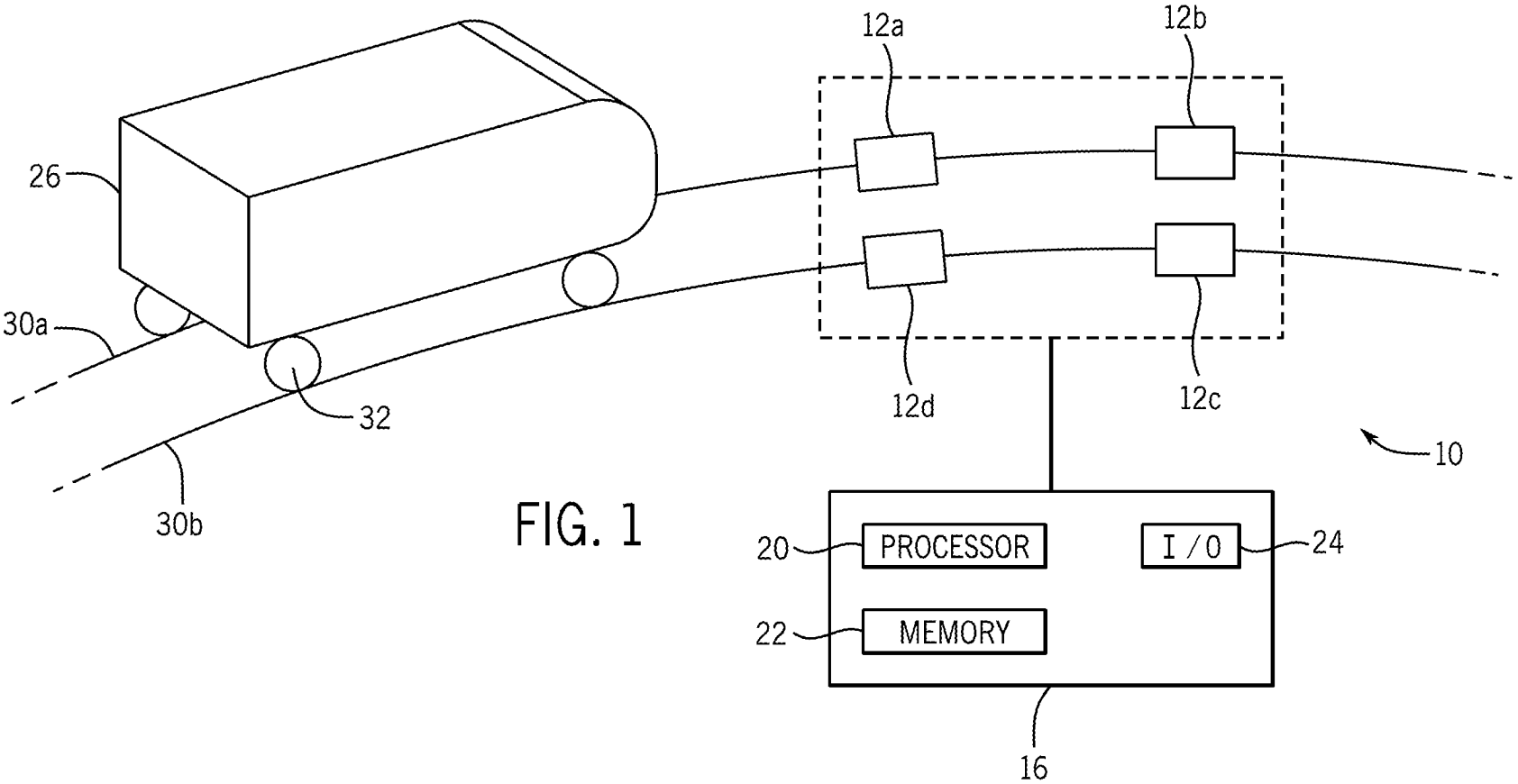
FIG. 1 is a schematic view of a vertically actuated motion base system used in conjunction with a vehicle track in accordance with present techniques.

Provided herein is a motion base system for use in conjunction with an amusement park ride. Vehicle-based rides have become more complex, with ride designers incorporating visual, audio, and motion-based effects into rides that augment the ride theme and that provide a more immersive experience. Certain ride vehicles are capable of providing integral ride effects, e.g., through the use of on-board speakers and projection screens as well as through control of vehicle motion using integral motion effects positioned within the vehicle that may tilt or shake the vehicle to enhance a ride narrative. For example, if a projection screen shows that the vehicle is approaching a virtual cliff, a vehicle may tilt forward to mimic falling over a cliff by tilting a passenger cab relative to a portion of the vehicle that remains on the ground.

However, because the vehicles are constrained by weight and power limitations, their on-board motion effects are similarly constrained. For more dramatic motion effects, ride designers may incorporate motion features directly into a vehicle ride path. That is, motion effects may be created by moving the floor or track to cause the vehicle positioned at the location of the feature to move. Such features may be implemented in conjunction with portions of the ride narrative to create large scale motion effects that may, for example, mimic being tossed by waves, being lifted by a monster, being fired upon, etc. In one example of such a technique, a ride vehicle drives onto a large platform that may pivot, turn, tilt, etc. to cause the vehicle to correspondingly move along with the platform. While such platforms may be capable of creating larger motion effects, their implementation is complex. For example, because the platforms are sized to lift an entire vehicle, they are generally large and heavy. Actuating such large and heavy platforms may also involve the use of hydraulic actuators, which in turn generate fluid waste that involves additional procedures for proper disposal.

The present techniques provide a motion base system that is smaller and lighter than single platform-based systems and, therefore, does not require the use of hydraulic actuators to generate sufficient actuation force. The motion base system includes distributed actuation decks that each support only a portion of a given ride vehicle. Accordingly, because the weight of the vehicle is distributed, each motion base may be smaller, more compact, and generally more energy-efficient relative to a single platform-based system. In certain embodiments, the motion bases include counterbalances that support the weight on each deck of the motion base, so that the actuation forces of each motion base are directed to acceleration of the actuatable components and not supporting the vehicle weight, which involves generally lower forces than those employed in weight support. In this manner, the motion bases system may generate less combined actuation force per unit vehicle weight than single platform-based systems, which in turn provides more flexibility and improvements in power distribution and power specifications for the system. In another embodiment, the distributed actuation also facilitates increased flexibility in creating actuation patterns to create more complex motion effects.

While the present techniques are disclosed in conjunction with an amusement park ride for creating motion effects for a ride vehicle, other embodiments of may involve actuating motion in other suitable settings. For example, the disclosed motion bases may be used in conjunction with animatronics, physical effects, flight or combat simulators, etc. In one embodiment, the motion base system may include distributed motion bases that support movement of different features of an animatronic figure. For example, an animatronic figure may be positioned atop a motion base to create movement in the figure in conjunction with the movement of the motion base. In another embodiment, the motion base system may include motion bases that support movement of large scale moveable features in an amusement park ride, e.g., features that do not carry passengers but that augment the ride experience by moving to support a ride narrative. For example, such features may include transforming cars, ships with simulated water movement, or physical barriers or gates in a ride that change positions as vehicles approach.

FIG. 1 is a schematic view of a motion base system 10 in accordance with the disclosed techniques that includes at least one actuatable motion base 12 (motions bases 12*a*, 12*b*, 12*c*, and 12*d* in the illustrated embodiment). The motion bases 12 are coupled directly or wirelessly to a controller 16, which is configured to provide signals to each motion base 12 to control the motion bases 12 independently of one another. To that end, the controller 16 may operate according to instructions executed by a processor 20 and stored in a memory 22. In addition, the controller 16 may have input/output controls to facilitate operator interaction with the system 10 as well as communication with other components of the system 10. In particular embodiments, the motion bases 12 may be used in conjunction with an amusement park vehicle ride to cause a vehicle 26 to move according to the actuation of the motion bases 12. The present techniques may be used to create motion effects for vehicles that are traveling along a ride route on a track 30, e.g., a track that includes rails 30*a* and 30*b*. In certain embodiments, the track may be a guide way, a virtual track or the vehicle may move in a track-independent manner. In such embodiments, the motion base system 10 may be integrated along the ride path in a floor or other section that the vehicle 26 passes over.

Upon entering a portion of the track 30 including the motion base system 10, the vehicle 26 may be programmed to pause to allow the motion base system 10 to initiate the motion. The system 10 may determine that the vehicle 26 is in position based on signals provided by one or more sensors on the vehicle 26 and/or on the motion base system 10 or the track 30. The one or more sensors may be coupled to the controller 16 to provide an input signal that triggers initiation of motion by the motion base system 10. By using a plurality of motion bases that move in particular patterns, the motion base system 10 is capable of causing vehicle motion in multiple degrees of freedom. Such motion may include pitch, roll, and heave as well as surge, sway, and yaw, either alone or in combination with one another. That is, for devices that are configured to actuate in the vertical direction, and in groups of four, arranged rectilinearly in plan view, the motion bases may be configured to cause pitch, roll, and heave. For devices with curved or angled paths, the motion bases may be arranged to create yaw, sway, and surge. Accordingly, the motion bases may be configured to create all six degrees of freedom, depending on the implementation and arrangement of the motion bases.

Figure 2:
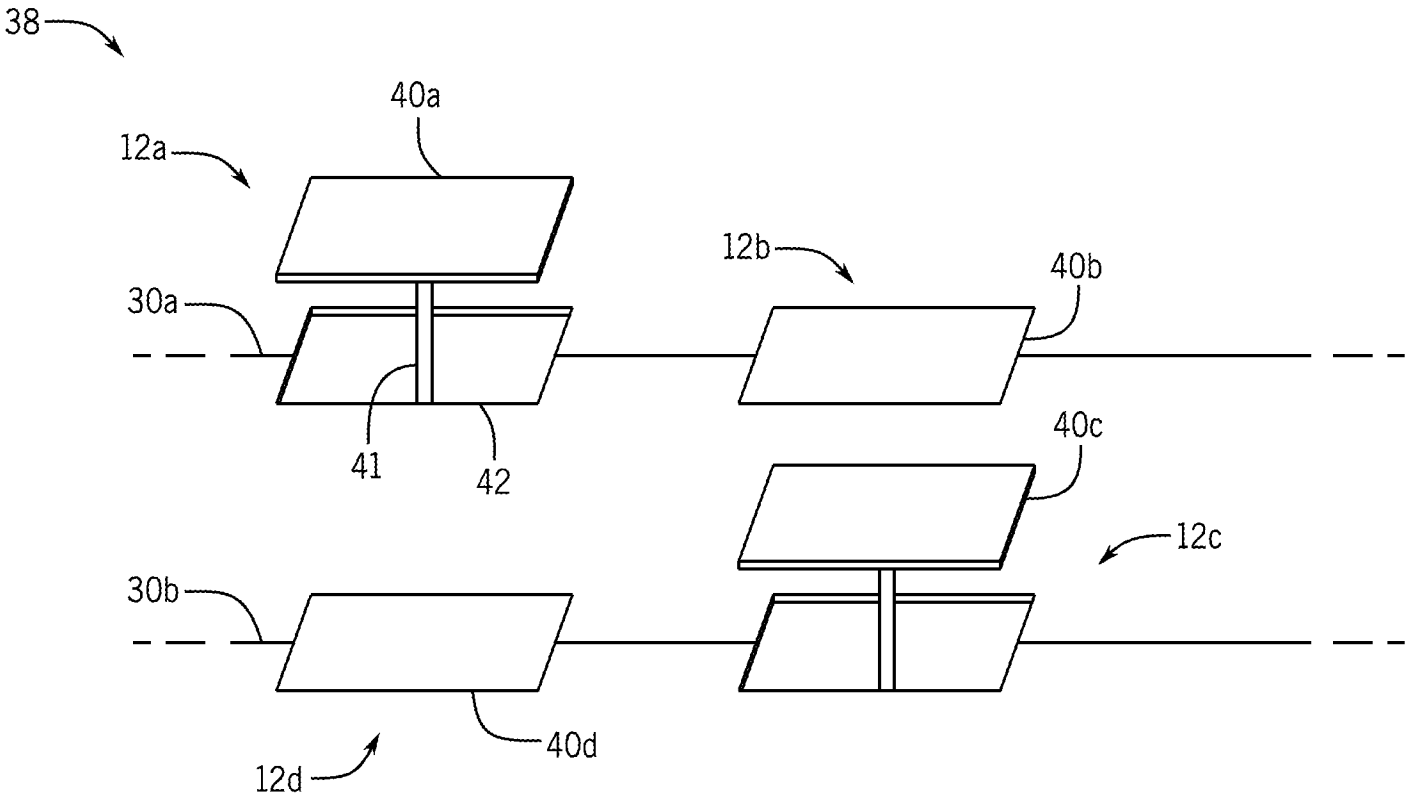
FIG. 2 is a schematic diagram of the motion base system of FIG. 1 in an actuated configuration in accordance with present techniques.

FIG. 2 is a schematic view of an actuation configuration 38 of a motion base system as in FIG. 1 in which the motion bases 12 have been independently actuated, e.g., as part of an actuation pattern. As illustrated, in the actuation configuration 38, a movable deck 40 of the motion base is actuated vertically out of the track 30 and out of the motion base housing 42. The decks 40 (40*a*, 40*b*, 40*c*, 40*d*) are each coupled to a corresponding actuation shaft 41 that lifts or lowers its respective deck 40 according to actuator movement under instructions from the controller 16 (see FIG. 1). For example, in FIG. 2, a portion of the decks 40 have actuated vertically relative to the track 30 while other decks 40 are still flush with the track 30, i.e., have not actuated. For example, in one embodiment, an actuation pattern includes one deck, e.g., 40*a* and 40*c*, on each rail, e.g., 30*a* and 30*b*, actuating above the level of the track 30 while the other decks 40*b* and 40*d* remain flush with the floor. If the motion bases 12 are configured such that each motion base 12 corresponds with the corners or wheels of the vehicle 26, such uneven actuation at the wheels or corners may result in a pitching, rolling, or heaving motion. In other embodiments, the vehicle 26 as provided herein may be configured with skids, mag lev, hover craft, etc.

It should be understood that the illustrated embodiment is one example of an actuation configuration 38, and the disclosed actuation patterns may include multiple different actuation configurations implemented in series or in parallel. The actuation patterns may include any number of actuation configurations. In one embodiment, the actuation pattern may include or start with a resting or inactive configuration in which all decks 40 are flush with the track 30 or the floor to create a relatively smooth surface to permit the vehicle 26 to drive onto the motion bases 12. In certain embodiments, the decks 40 may include a lip or other features to assist with positioning the wheels on the decks 40. The actuation pattern may also finish in the inactive configuration to permit the vehicle 26 to move past the motion base system 10 and complete the ride. The inactive configuration may approximately align the planes of each deck 40 with one another and with the track 30. In another embodiment, because the controller 16 is configured to move the deck 40 of each motion base 12 independently of the other decks 40, an actuation configuration may include only one deck 40 actuated in a position outside of its housing 42, only two or three decks actuated in a position outside of its housing 42, or all of the decks 40 actuated in a position outside of their respective housings 42.

The depicted embodiment includes four motion bases 12 that are generally sized and positioned to align with four wheels of the vehicle 26. In one embodiment, the four motion bases 12 form vertices of a rectangle or square. In another embodiment, the four motion bases 12 are spaced apart so that their housings 42 are not in direct contact with one another, although the motion bases 12 may be electrically coupled by one or more electrical leads to the controller and/or a common power source. However, it should be understood that the system 10 may be implemented with any suitable number of motion base 12. For example, the system 10 may include a 1, 2, 3, 4, 5, 6 or more motion bases 12. Further, each individual ride may include multiple motion base systems 10.

Figure 3:
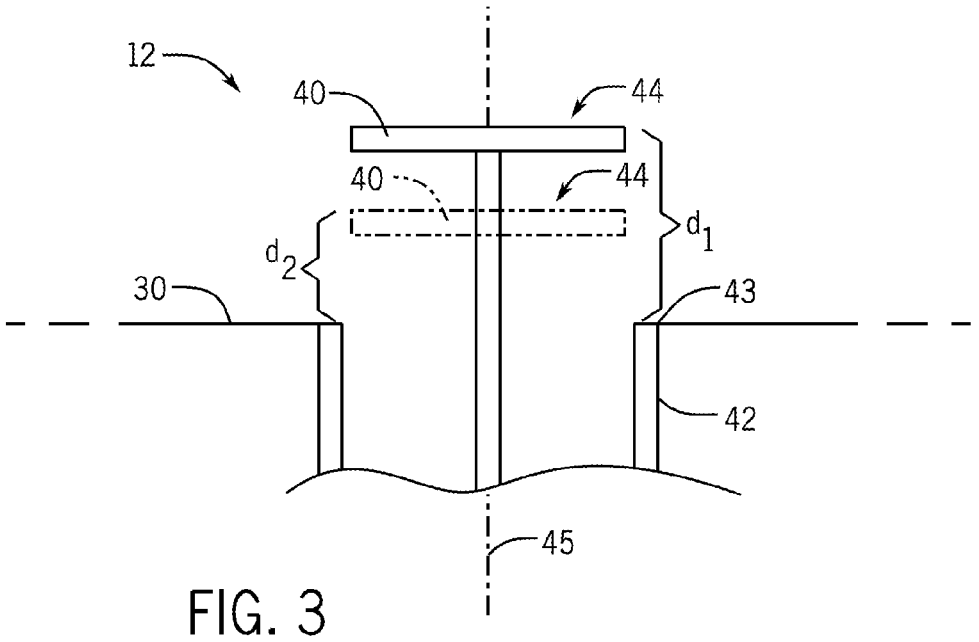
FIG. 3 is a side cutaway view of an individual motion base of the motion base system of FIG. 1 in an actuated position in accordance with present techniques.

FIG. 3 is a side cutaway view of an individual motion base 12 in which the motion deck 40 is actuated out of the housing 42. The maximum actuation distance $d_1$ may be defined by the distance between any fixed component of the motion base 12 or the floor or track 30 and any actuatable component that actuates together with the deck 40. In the depicted embodiment, the maximum actuation distance $d_1$ is defined by a distance between a top surface of the housing 42 (or the surface of the track 30 or ride floor) and a top surface 44 of the deck 40 along an axis 45 that is approximately orthogonal to a plane defined by the deck 40. The deck 40 may actuate between an inactive configuration, which may be flush with the floor or track 30 or the top surface 43 of the housing 42, and a maximum actuation configuration in which the deck 40 is actuate the distance $d_1$. Further, the deck 40 may be actuated under controller instructions to a plurality of positions between the inactive configuration and the maximum actuation configuration, such that a distance $d_2$ may be any distance greater than zero up to and including $d_1$. Because each motion base deck 40 may be actuated separately to positions having a distance between zero and $d_1$, inclusive, an individual actuation configuration may include a number of possible actuation distances for each deck 40. For example, an actuation configuration may include positioning respective decks 40 at a plurality of individual distances $d_2$ that are all different from one another. In certain embodiments, the decks 40 may also actuate to positions within the housing 42 such that the deck 40 may be recessed within the housing and below the level of the floor. In such embodiments, the maximum recessed distance may be defined by the positions of the internal components of the motion base, such as the length of the actuation shaft 41. Further, the respective decks 40 in a multi-deck configuration may actuate along axes approximately parallel to one another in certain embodiments.

Figure 4:
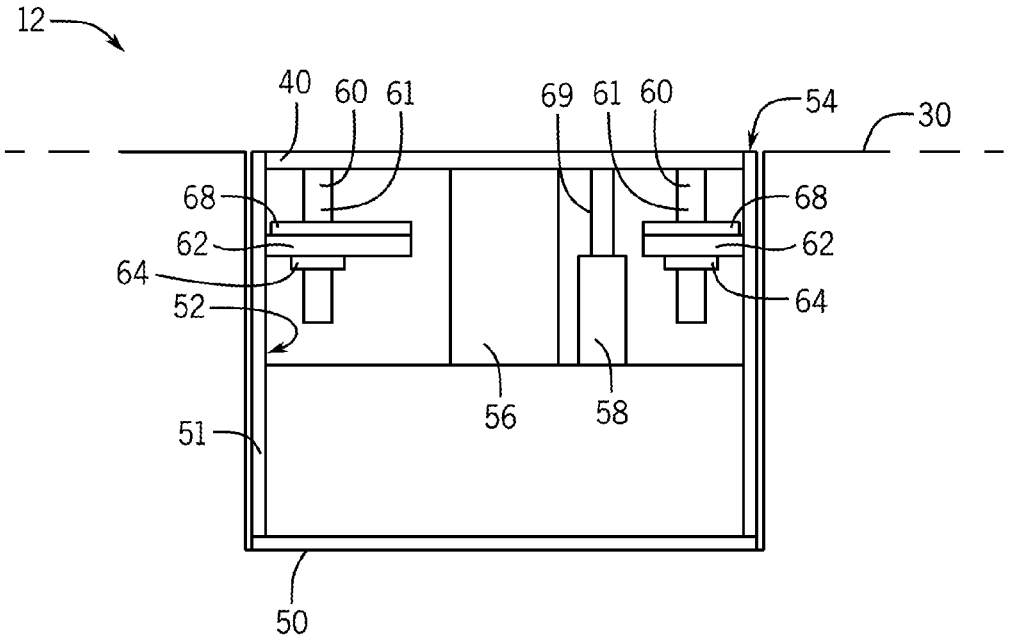
FIG. 4 is a cross-sectional view of an embodiment of an individual motion base of a motion base system in accordance with present techniques.

FIG. 4 is a cross-sectional view of one implementation of a motion base 12. The motion base 12, as illustrated, is positioned within a housing 50 having approximately parallel side walls 51 defining interior surfaces 52 and terminating at proximal ends 54 that are proximate to the track 30. However, other implementations (e.g., non-parallel side walls 51) are contemplated. The deck 40 is sized and shaped to fit within a space defined by the side walls 51 and may, in certain embodiments, seal or close off the interior of the motion base 12 when in the inactive configuration, as depicted. The motion base 12 also includes a counterbalance coupled to the deck 40 that supports the weight of the deck 40 and, in certain embodiments, is configured to support a weight positioned on the deck 40. The counterbalance may be a fluid bladder, a spring (e.g., an air spring, a gas spring, a mechanical spring, a magnetic spring, a spring including quantum locking elements, a pneumatic spring), an oleo-pneumatic strut, or similar structures. In certain embodiments, the counterbalance may be a spring configured as a coil, leaf, torsion bar, Bellville washer stack, etc. In another embodiment, the counterbalance may be a rigged weight acting on a motion base 12 via rigging, simple leverage, a bar link, etc. Further, it should be understood that the counterbalance may include one or more of counterbalance structures as provided herein.

The motion base 12 may also include an actuator 58 that may include one or more motors and associated devices, e.g., rotary actuator, servo, or the like. The actuator 58 may be electrically, pneumatically or hydraulically driven, or any combination thereof. However, in particular embodiments, the motion base system 10 does not include any hydraulic components. The motor may be coupled to the controller 16 (see FIG. 1), either wirelessly or via electrical leads, and to an individual or shared power source. In addition, the motion base 12 may include one or more motion control components 60 that guide the actuation movement. In the depicted embodiment, the motion base 12 may include a plurality of motion control components 60. The motion control component 60 may include a shaft and a motion guide 62 sized and configured to abut or slide along the side wall 51 of the housing 50 to limit a range of actuation of the deck to a generally vertical axis (e.g., along axis 45 of FIG. 3). The motion guide 62 may be coupled to the shaft 61 via coupler 64. Further, the motion control component 62 may include one or more bumpers or shock absorbers 68. The size and shape of the motion guide 62 and/or the side walls 51 may define a guide path of the deck actuation. For example, a curved motion guide 62 that follows a curved side wall 51 may define a curved guide path of actuation. Similarly, if the motion guide 62 defines a straight line that follows a straight side wall 51, the guide path may be straight or along an axis. The axis may be orthogonal or angled relative to the track 30. Further, each individual motion base 12 may feature the same or different guide paths relative to one another. In certain embodiments, motion bases 12 with different guide paths may increase the complexity of the actuation patterns.

Certain components of the motion base 12 may be directly coupled to the deck 40 such that actuation of the deck 40 results in corresponding movement of the coupled components. For example, the actuator 58 may be coupled to the deck 40 via a shaft 69 or other connector. Upon actuation of the motor, the shaft 69 translates in a vertical direction, which in turn causes the deck to move 40 relative to the fixed housing 50. In turn, movement of the deck 40 may stretch a bladder or spring of the counterbalance 56 and may cause the one or more motion guides to move relative to the side walls 51.

Figure 5:
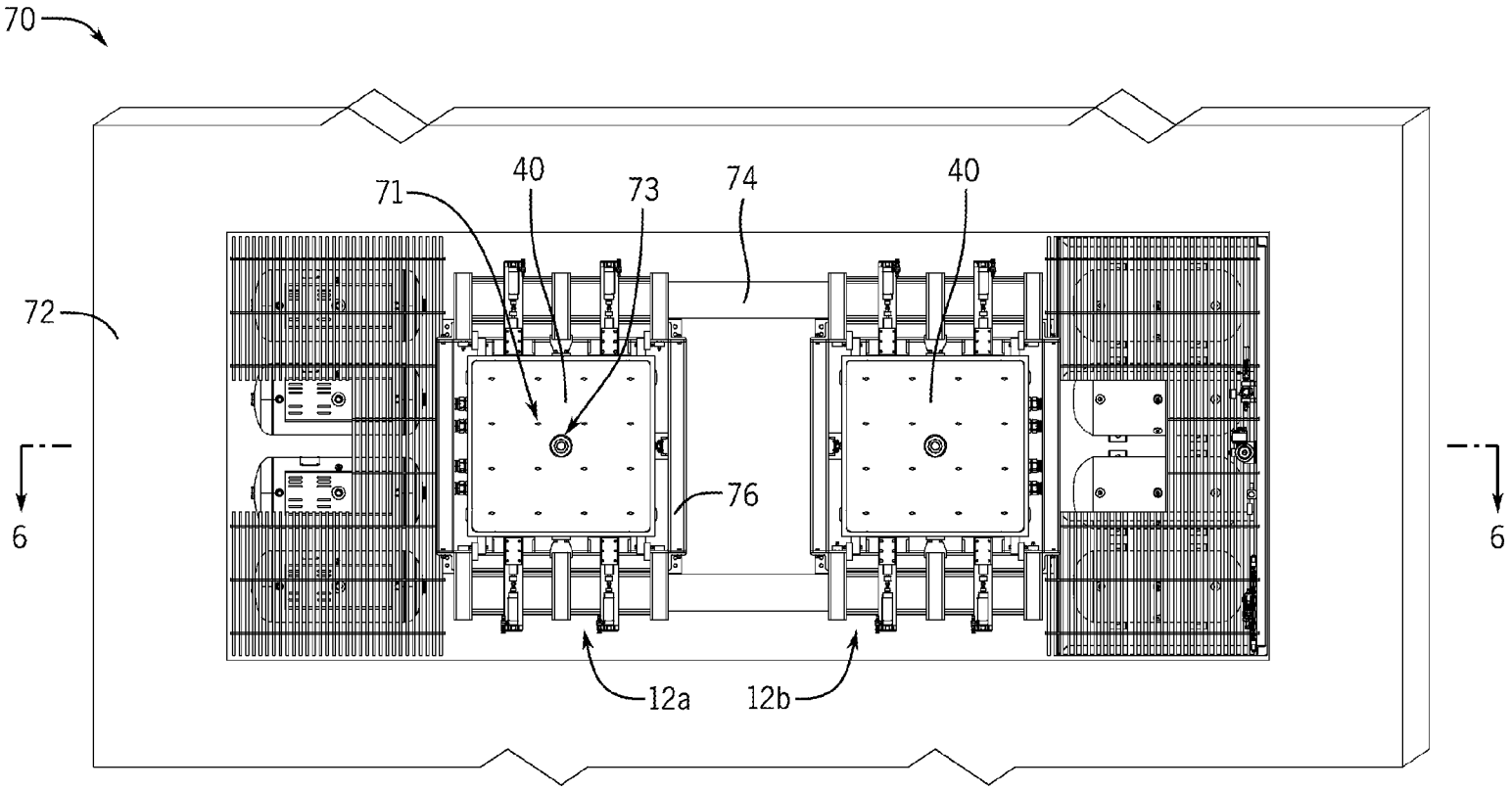
FIG. 5 is a top view of a facility including multiple motion bases in accordance with present techniques.

While each motion base 12 may be controlled independently, in certain embodiments, the system 10 may include outer facilities that encompass additional related components to facilitate motion base actuation and that may include one or more motion bases 12. FIG. 5 is a top view of a facility 70 that is positioned about motion bases 12*a* and 12*b*. The facility may be sized and shaped for modular insertion in a corresponding location in a track or vehicle path and may permit access for repair or service. The top surfaces of the motion decks 40 may include sensors 73 to determine if a vehicle is properly positioned so that motion may be initiated. Further, the top surfaces may include gripping 71 or other features to facilitate alignment of the vehicle on the decks 40. The facility 70 includes an outer shell 72 and a brace 74 to which the carriage housings 76 of the motion bases 12 are coupled. As shown, the motion bases 12 and their respective decks 40 are within the same facility 70 but are spaced apart from one another.

Figure 6:
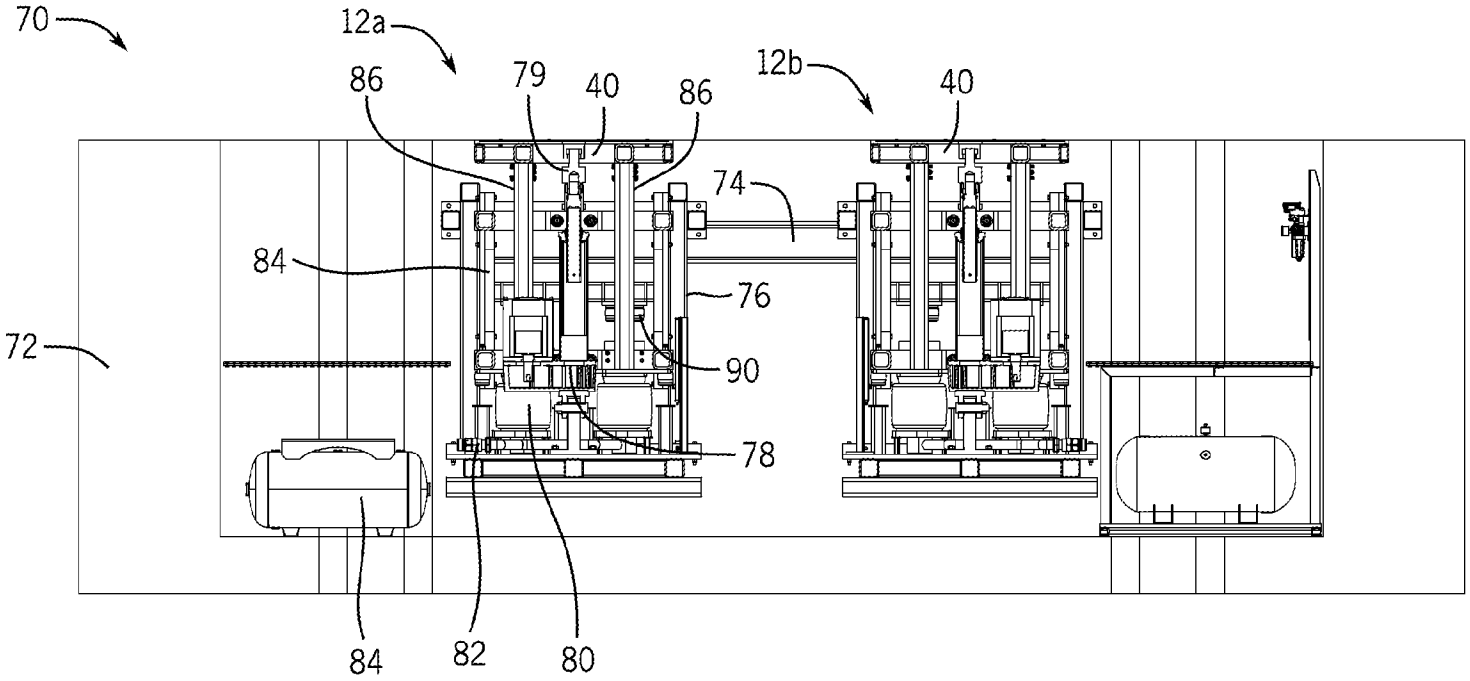
FIG. 6 is a cross-sectional view of the facility of FIG. 5.

FIG. 6 is a cross-sectional view of the facility of FIG. 5. In the depicted embodiment, the actuator 78 is an electrical actuator coupled to the deck 40 via a coupler 79. Each motion base 12 includes two fluid springs 80 that serve as the weight counterbalance. Pressure in the fluid springs 80 is provided by one or more fluid sources 84 fluidically coupled to the fluid springs 80 via fluid coupler 82 and that provide a fluid (e.g., air, water, motion damping fluids). The fluid sources 84 are within the shell 72 and, in embodiments of the present techniques may be positioned within or outside of the housing 76. The fluid springs 80 are coupled to the deck 40 via shafts 86 such that actuation of the deck 40 results in a change in pressure in the fluid springs 80 as the fluid spring volume increases due to active stretching. In certain embodiments, fluid spring pressure in the various actuated positions may be adjusted to maintain a desired counterbalance. During actuation, one or more side rails 84 may slide against and relative to the housing 76. Alternatively, a structure coupled to the actuator 78 and the fluid springs 80 may slide up and down the side rails 84 during actuation. Regardless of the mechanism of actuation, the side rails 84 may serve to control the actuation movement in a generally vertical direction. It should be understood that, depending on the configuration of the housing 76 and the motion control components, the direction of actuation may be controlled a non-vertical direction. For example, the deck 40 may be actuated at an angle, which may be appropriate if a vehicle path is banked or curved.

Figure 7:
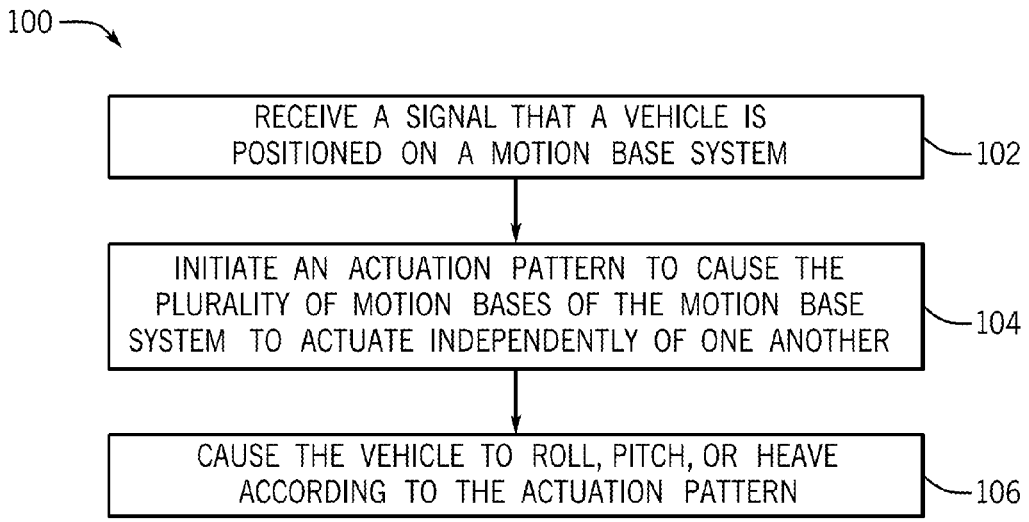
FIG. 7 is a flow diagram of an embodiment of an actuation method for actuating a motion base system in accordance with present techniques.

FIG. 7 is a flow diagram of a method 100 of using a motion base system 10 in conjunction with a vehicle (e.g., the vehicle 26 as shown in FIG. 1). The method 100 includes receiving (e.g., at a controller) an indication that a vehicle is positioned appropriately on the motion bases 12 of the motion base system 10. For example, the positioning may be indicated by position sensors on the vehicle, pressure sensors on the vehicle and/or the motion bases, or by cameras or optical sensors. Proper positioning may include alignment of the wheels of the vehicle with the motion bases 12. The sensors provide a signal that is received by the controller (block 102), which in turn initiates an actuation pattern to cause the plurality of motion bases to actuate independently of one another (block 104). The actuation pattern may include one or more actuation configurations (e.g., such as the actuation configuration 38 of FIG. 2). If the actuation pattern includes a plurality of actuation configurations operated in series, the actuation pattern may also include timing information for the transition between such configurations. That is, the pattern may hold a particular configuration for a set amount of time or may specify the speed of actuation to enhance certain type of motion. In one embodiment, the memory 22 of the controller 16 may store a plurality of actuation patterns that generate different types of movement, such as roll, pitch, heave, or any combination thereof. The actuation pattern may be fixed such that receiving the signal results in initiation of a particular pattern, or the actuation pattern may be selected based on other factors (e.g., passenger input, updated ride parameters), such that a particular pattern is selected from a group of actuation patterns and executed under processor control. Accordingly, execution of the actuation pattern causes the vehicle to roll, pitch, or heave (block 106) according to the instructions provided by the controller 16. Further, other types of movement may be generated. In one embodiment, actuation of the bases 40 along different angles, curves, or paths (e.g., via actuation guide paths) may result in one or more of a yaw, surge, or sway motion.

Figure 8:
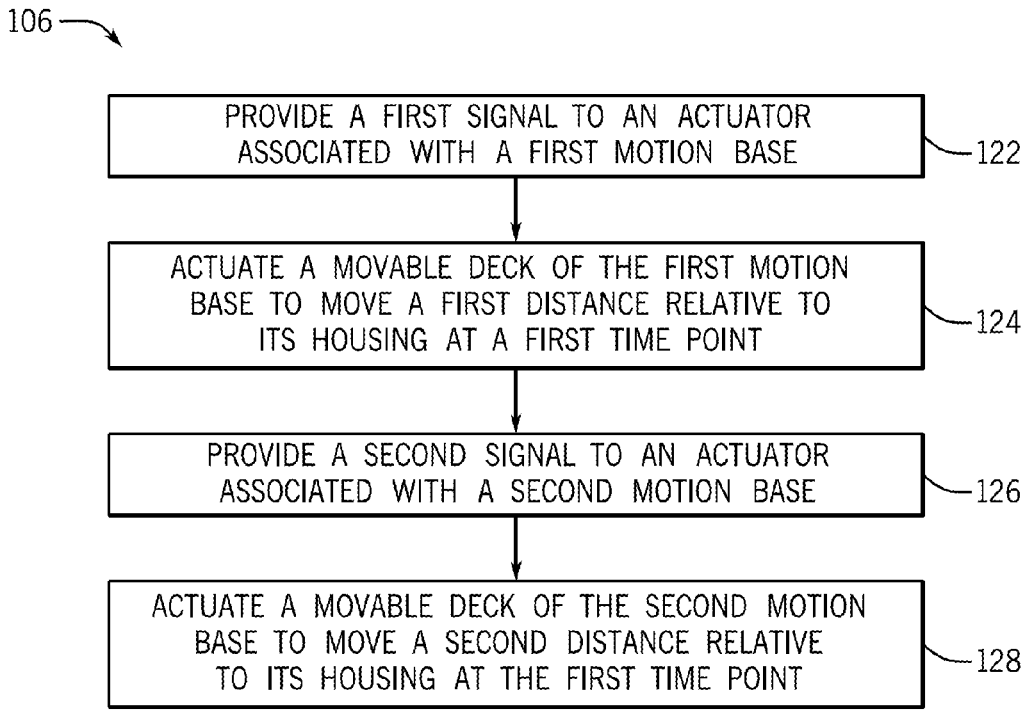
FIG. 8 is a flow diagram of an embodiment of an actuation method for actuating a motion base system in accordance with present techniques.

FIG. 8 is a flow diagram of a specific embodiment of causing a vehicle to pitch, roll, or heave according to the actuation pattern (block 106 of FIG. 7), which may be a computer program executed by a processor 20 coupled to the controller 16. The processor may provide a first signal to an actuator associated with a first motion base (block 122), which in turn results in actuation of a movable deck of the first motion base to move a first distance relative to its housing at a first time point (block 124). The processor also may provide a second signal to an actuator associated with a second motion base (block 126), which in turn results in actuation of a movable deck of the second motion base to move a second distance relative to its housing at the first time point (block 128). In particular embodiments, the processor may provide third, fourth, fifth, etc. signals at the first time point to respective third, fourth, fifth, or more motion bases, depending on the particular configuration of the system 10. The movement distances may be defined by the controller according to the desired actuation pattern. For example, if movement as part of a roll movement pattern is associated with an actuation configuration, the controller provides signals to all of the motion bases to move their respective decks to specific positions at a certain time point. The pattern may also include transition of all or some of the motion base decks to another location as the pattern continues. Accordingly, the method 106 may include a return to step 122 and/or step 126 to provide actuation signals at a second time point, a third time point, etc. For certain actuation patterns, a particular motion base deck may stay in position over particular time points while other decks move. Accordingly, the method may also include not providing an actuation signal to a subset of the motion bases while providing an actuation signal to another subset of the motion bases at particular time points. Further, actuation signals may also be provided to additional motion bases at additional time points.

Figure 9:
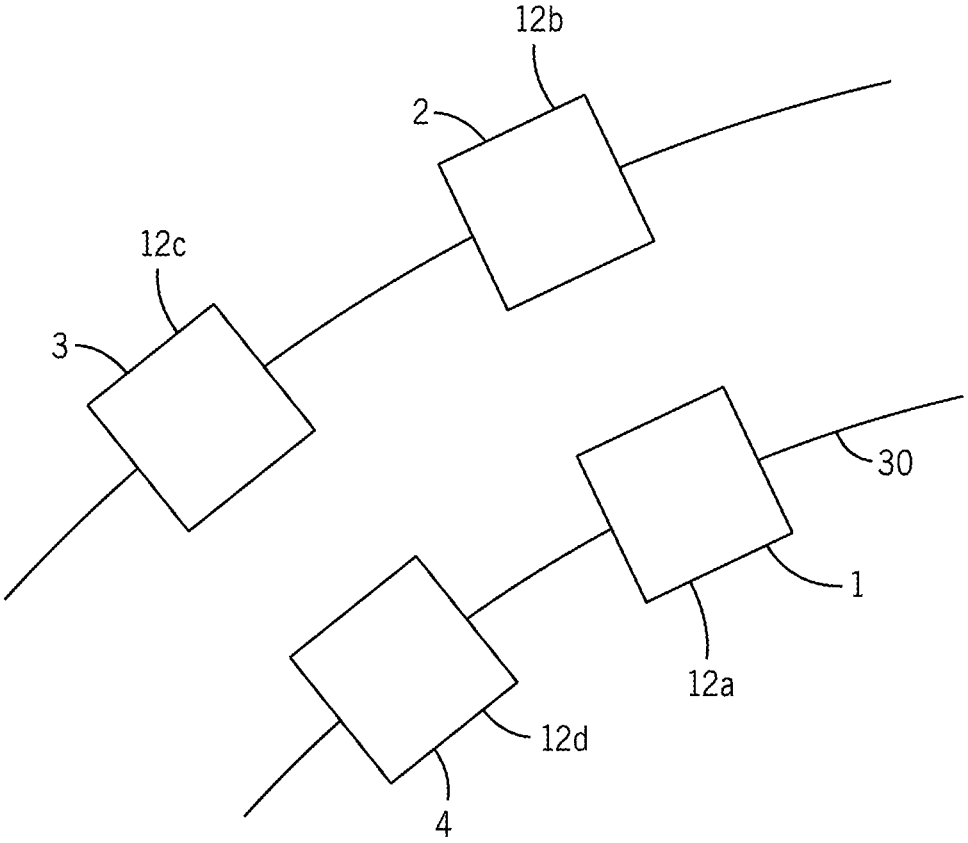
FIG. 9 is a top view of an arrangement of motion bases in accordance with present techniques

In a particular embodiment, as shown in FIG. 9, the motion base system 10 includes at least four motion bases 12 arranged rectilinearly in plan view and that are configured to actuate vertically. If the motion bases are numbered starting from the forward right position of a vehicle (e.g., vehicle 26) with four wheels and arranged in the track such that the four wheel f a vehicle are positioned on respective motion bases 1,2,3, and 4 (or 12*a*, 12*b*, 12*c*, and 12*d*), certain actuation patterns may be created by actuating particular motion bases in order. For example, for motion predominantly in a roll axis (where the forward direction of the track is considered the x-axis), actuation in the pattern of motion base 1 being raised relative to motion base 2 and/or motion base 4 being raised relative to motion base 3 would create roll axis motion in one direction. The reverse of the actuation pattern (e.g., 2 raised relative to 1 and/or 4 raised relative to 3) would create roll axis motion towards the opposite direction. Further, motion predominantly in a pitch axis may be created by raising 4 relative to 1 and/or 3 relative to 2, while the reverse of the pattern would generate backwards pitch axis motion. Heave may be generated by an up and down motion, created by simultaneous actuation of the motion bases 1,2,3, and 4 to move the vehicle up or down. Further, the heave motion may include a superimposed pitch or roll. For example, the four motions bases may be translated substantially simultaneously in an up or down direction with motion base 1 being translated to a higher final position than motion base 2 to create heave with a superimposed roll. Likewise, simultaneous translation of the four bases but with motion base 4 being translated to a different position relative to motion base 1 may result in heave with a superimposed pitch. Other combinations are also contemplated.

As provided herein, certain elements of the disclosed embodiments may be coupled to one another. Such coupling may be communicative coupling, physical coupling, electrical coupling, and/or mechanical coupling. For example, coupled elements may communicate with one another to exchange data or information. In another embodiment, coupled elements may be in direct physical contact or may be coupled together via intermediate components. In yet another embodiment, coupled elements may be disposed on another. In yet another embodiment, an element may rest on an element to which it is coupled. Coupling as provided herein may be fixed or reversible.

While only certain features have been illustrated and described herein, many modifications and changes will occur to those skilled in the art. It is, therefore, to be understood that the appended claims are intended to cover all such modifications and changes as fall within the true spirit of the disclosure. While certain disclosed embodiments have been disclosed in the context of amusement or theme parks, it should be understood that certain embodiments may also relate to other pedestrian destinations, including city parks, state parks, museums, etc. Further, it should be understood that certain elements of the disclosed embodiments may be combined or exchanged with one another.

The invention claimed is:

1. An amusement park ride system, comprising:

one or more motion base systems coupled to a vehicle path of a ride vehicle, wherein each motion base system comprises:

a plurality of motion bases configured to actuate independently of one another to create motion effects for the ride vehicle when the ride vehicle is in contact with the plurality of motion bases, wherein each motion base of the plurality of motion bases comprises:

a housing;

a deck configured to contact a portion of the ride vehicle and move relative to the housing along a guide path when actuated;

an actuator coupled to the deck and configured to cause the deck to be actuated;

a counterbalance coupled to the deck and configured to change an internal pressure or move when the deck is actuated; and one or more motion guides coupled to the deck and configured to move in conjunction with the deck relative to the housing when the deck is actuated to define the movement of the deck along the guide path; and wherein the one or more motion base systems further comprise a controller coupled to the plurality of motion bases and configured to control the actuator of each respective motion base of the plurality of motion bases such that the decks of the plurality of motion bases move independently of one another while in contact with the ride vehicle to create motion effects for the ride vehicle.

2. The system of claim 1, wherein the respective decks of the plurality of motion bases are positioned on the vehicle path to align with respective supports elements the ride vehicle when the ride vehicle is positioned on the vehicle path at a location corresponding to the plurality of motion bases.

3. The system of claim 1, wherein the respective housings of the plurality of motion bases do not contact one another.

4. The system of claim 1, wherein the controller is configured to activate the plurality of motion bases to actuate independently such that the ride vehicle experiences a motion effect about a roll axis.

5. The system claim 1, wherein the controller is configured to activate the plurality of motion bases to actuate independently such that the ride vehicle experiences a motion effect about a pitch axis.

6. The system of claim 1, wherein the controller is configured to activate the plurality of motion bases to actuate independently such that the ride vehicle experiences a heave motion effect.

7. The system of claim 1, wherein actuation of each respective deck of the plurality of motion bases comprises movement of the respective deck to a position selected from a fixed range of positions along the guide path and wherein the fixed range of positions comprises positions wherein the respective deck is at least partially within the housing, flush with a floor surface, or above a level of the floor surface.

8. The system of claim 7, wherein the floor surface is planar or curved.

9. The system of claim 7, wherein the fixed range of positions comprises a range of distances relative to a fixed point on the respective housings of the individual motion bases of the plurality of motion bases.

10. The system of claim 9, wherein the controller is configured to control actuation of the deck to cause individual decks of respective motion bases of the plurality of motion bases to be positioned at different distances relative to the floor surface.

11. The system of claim 1, wherein the respective decks of the plurality of motion bases actuate along respective axes that are approximately parallel to one another.

12. The system of claim 1, wherein the deck is configured to actuate along an axis approximately orthogonal to a plane formed by the deck.

13. The system of claim 1, wherein the one or more motion guides are directly coupled to the deck.

14. The system of claim 1, wherein the one or more motion guides comprise a rail or guide configured to slide along a wall of the housing when the deck is actuated.

15. The system of claim 1, wherein the guide path comprises a curved or angled path.

16. The system of claim 1, wherein the counterbalance comprises a fluid bladder and one or more fluid reservoirs fluidically coupled to the fluid bladder.

17. The system of claim 16, wherein an internal pressure in the fluid bladder of the motion base is sufficient to support a weight of the deck when the deck is in an inactive position or is not actuated and a portion of a load is positioned on the deck.

18. A motion base system, comprising:

a plurality of motion bases configured to acutate independently of one another to create motion effects for a ride vehicle in contact with the plurality of motion bases, each motion base of the plurality of motion bases comprising:

a housing;

a deck configured to contact a portion of the ride vehicle and move relative to the housing when actuated;

an actuator coupled to the deck and configured to cause the deck to be actuated;

a counterbalance coupled to the deck and configured to bear a weight of the deck and an additional load resting on or coupled to the deck; and one or more motion guides coupled to the deck and configured to move in conjunction with the deck relative to the housing when the deck is actuated to constrain the movement of the deck; and a controller coupled to the plurality of motion bases and configured to control the actuators of the plurality of motion bases to actuate the decks of the plurality of motion bases to move between a plurality of positions as part of an actuation pattern such that the decks of the plurality of motion bases move independently of one another while in contact with the ride vehicle to create motion effects for the ride vehicle.

19. The system of claim 18, wherein the counterbalance comprises a fluid bladder.

20. The system of claim 18, wherein the counterbalance comprises a spring.

21. The system of claim 20, wherein the spring is a pneumatic spring, a magnetic spring, a quantum locking spring, or a mechanical spring.

22. The system of claim 18, wherein the counterbalance comprises a rigged weight.

23. The system of claim 18, wherein each motion base of the plurality of motion bases comprises one or more sensors configured to provide a signal when the ride vehicle is positioned on a surface of a corresponding deck of the plurality of motion bases.

* * * * *